US010175640B1

(12) United States Patent
Kamiya et al.

(10) Patent No.: US 10,175,640 B1
(45) Date of Patent: Jan. 8, 2019

(54) ASSEMBLY REMOVABLE STRUCTURE AND IMAGE FORMING APPARATUS

(71) Applicant: FUJI XEROX CO., LTD., Tokyo (JP)

(72) Inventors: Shogo Kamiya, Kanagawa (JP); Masakatsu Eda, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 15/952,244

(22) Filed: Apr. 13, 2018

(30) Foreign Application Priority Data

Jul. 3, 2017 (JP) ..... 2017-130614

(51) Int. Cl.
*G03G 21/16* (2006.01)
*G03G 15/20* (2006.01)

(52) U.S. Cl.
CPC ..... *G03G 21/1685* (2013.01); *G03G 15/2064* (2013.01); *G03G 2221/1639* (2013.01)

(58) Field of Classification Search
CPC ..... G03G 21/1685; G03G 21/1633; G03G 21/1661; G03G 21/1842; G03G 15/2064; G03G 2221/1639
See application file for complete search history.

(56) References Cited

U.S. PATENT DOCUMENTS

2013/0077993 A1* 3/2013 Arikawa ..... G03G 21/1685 399/122
2014/0153965 A1* 6/2014 Nanno ..... G03G 21/1685 399/122
2016/0274526 A1* 9/2016 Ochi ..... G03G 15/757

FOREIGN PATENT DOCUMENTS

JP H11-126009 5/1999

* cited by examiner

*Primary Examiner* — Sophia S Chen
(74) *Attorney, Agent, or Firm* — JCIPRNET

(57) ABSTRACT

An assembly removable structure includes an assembly that includes a connectable member and that is attached to and removed from a receiving member of an apparatus body in a first direction, a connection member disposed on the apparatus body to be movable forward and backward in a cross direction that crosses the first direction, the connection member being connected to the connectable member while being in a projecting state, a switch member operated independently of a lid member and capable of switching the connection member between a first position, in which the connection member is connected to the connectable member, and a second position, in which the connection member is removed from the connectable member, the lid member rendering the receiving member open and closed, and a holding device that holds the switch member in the second position when the assembly is removed from the receiving member.

12 Claims, 14 Drawing Sheets

ASSEMBLY REMOVABLE STRUCTURE AND IMAGE FORMING APPARATUS

CROSS-REFERENCE TO RELATED APPLICATIONS

This application is based on and claims priority under 35 USC 119 from Japanese Patent Application No. 2017-130614 filed Jul. 3, 2017.

BACKGROUND

Technical Field

The present invention relates to an assembly removable structure and an image forming apparatus.

SUMMARY

An assembly removable structure according to an aspect of the invention includes an assembly that includes a connectable member and that is attached to and removed from a receiving member of an apparatus body in a first direction, a connection member disposed on the apparatus body to be movable forward and backward in a cross direction that crosses the first direction, the connection member being connected to the connectable member while being in a projecting state, a switch member that is operated independently of a lid member and that is capable of switching the connection member between a first position, in which the connection member is connected to the connectable member, and a second position, in which the connection member is removed from the connectable member, the lid member rendering the receiving member open and closed, and a holding device that holds the switch member in the second position when the assembly is removed from the receiving member.

BRIEF DESCRIPTION OF THE DRAWINGS

Exemplary embodiments of the present invention will be described in detail based on the following figures, wherein.

DETAILED DESCRIPTION

First Exemplary Embodiment

An assembly removable structure and an image forming apparatus according to the present exemplary embodiment are described as examples.

Entire Structure

Figure 1:
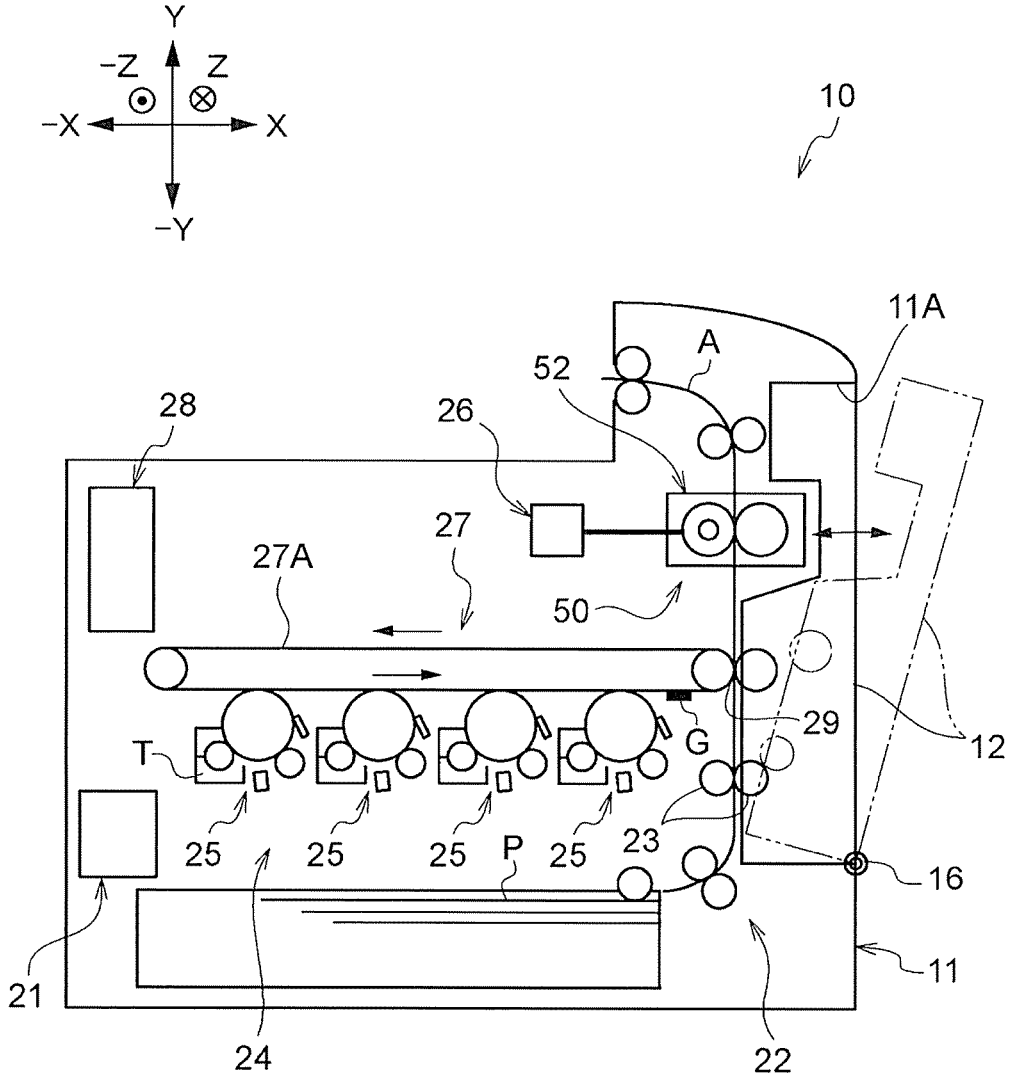
FIG. 1 illustrates an image forming apparatus according to a first exemplary embodiment.

FIG. 1 illustrates an image forming apparatus 10 according to the first exemplary embodiment. In the following description, the direction indicated with arrow Y in FIG. 1 refers to an apparatus height direction, and the direction indicated with arrow X in FIG. 1 refers to an apparatus width direction. The direction (indicated with Z) perpendicular to the apparatus height direction and the apparatus width direction in FIG. 1 refers to an apparatus depth direction. When the image forming apparatus 10 is viewed from the front, the apparatus height direction, the apparatus width direction, and the apparatus depth direction are respectively referred to as a Y direction, an X direction, and a Z direction. When each of the X, Y, and Z directions needs to have its one and the opposite sides distinguished from each other, the upper side is referred to as a Y side, the lower side is referred to as a −Y side, the right side is referred to as an X side, the left side is referred to as a −X side, the rear side is referred to as a Z side, and the front side is referred to as a −Z side, when the image forming apparatus 10 is viewed from the front.

The image forming apparatus 10 includes a box-shaped apparatus body 11. The apparatus body 11 houses a receiving member 13 (see FIG. 2) to which a fixing unit 52, described below, is attached. The receiving member 13 is described in detail below. The apparatus body 11 has a cut in an X side portion. The cut portion is referred to as an opening 11A. A hinge 16, rotatable about its axis extending in the Z direction, is disposed on a −Y side end portion of the opening 11A. A covering 12, which is an example of a lid member, has its −Y side end portion attached to a movable portion of the hinge 16.

For example, the covering 12 has a U-shaped cross section when viewed in the Z direction and extends in the Y direction. The covering 12 is arcuately movable about the hinge 16 between a closed position, in which it closes the opening 11A, and an open position, in which it allows the opening 11A to open. In the state where a fixing unit 52, described below, is attached to the receiving member 13, the covering 12 in the closed position covers a pair of positioning rollers 23, a second transfer portion 29, and the fixing unit 52, and the covering 12 in the open position allows the pair of positioning rollers 23, the second transfer portion 29, and the fixing unit 52 to be exposed from the apparatus body 11. The pair of positioning rollers 23 are described below. In other words, the covering 12 renders the receiving member 13 open and closed.

The image forming apparatus 10 includes a power supply 21, a transport portion 22, an image forming unit 24, a removable structure 50, which is an example of an assembly removable structure, a driver 26, and a controller 28. The transport portion 22 includes multiple rollers including the pair of positioning rollers 23 to transport sheets P along a transport path A. The sheets P are an example of a recording medium. The transport path A, for example, extends in the Y direction from a lower portion on the −Y side to an upper portion on the Y side of the apparatus body 11.

The image forming unit 24 is an example of a developer image forming device, and includes multiple image forming units 25 and a transfer unit 27. The image forming unit 24 forms toner images G using toner T on a sheet P transported by the transport portion 22. The toner T is an example of a developer. The toner images G are an example of an image and a developer image. The multiple image forming units 25 perform, for example, charging, exposure, and development operations in the known electrophotographic system.

The transfer unit 27 includes an intermediate transfer belt 27A to which toner images G are first-transferred and which second-transfers the first-transferred toner images G onto the sheets P at the second transfer portion 29 on the transport path A. The controller 28 controls operations such as power supply from the power supply 21 to each component of the image forming apparatus 10, transportation of the sheets P performed by the transport portion 22, an image forming operation of the image forming unit 24, and an operation of the driver 26.

Driver

The driver 26 includes a motor, which is not illustrated and rotates a coupling member 54 (see FIG. 2) described below. The driver 26 has its driving operation controlled by the controller 28.

Receiving Member

Figure 2:
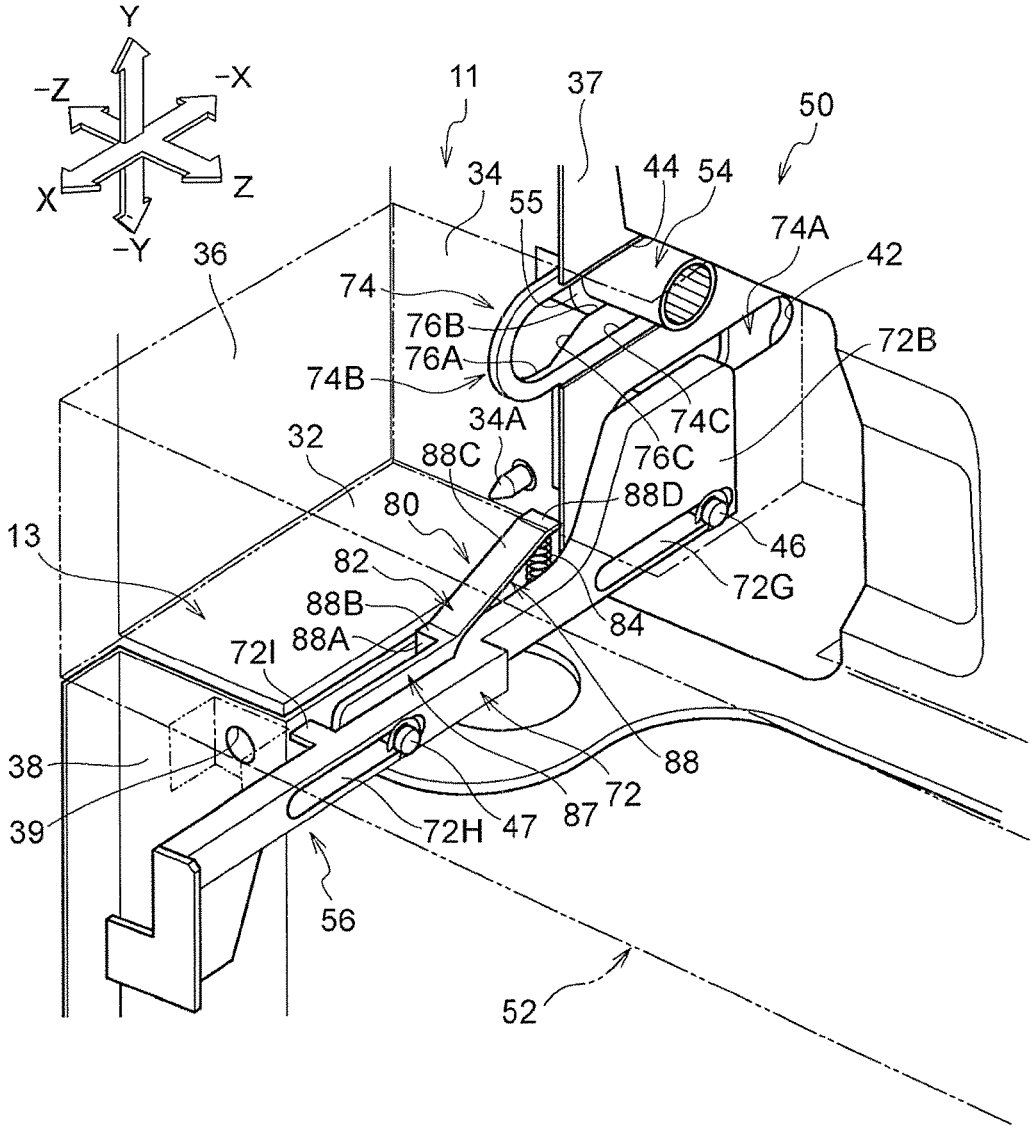
FIG. 2 illustrates a fixing unit according to the first exemplary embodiment attached to a receiving member and a link member in a first position.

The receiving member 13 shown in FIG. 2 is disposed on the X side of the center of the apparatus body 11 in the X direction and on the Y side of the center of the apparatus body 11 in the Y direction. The receiving member 13 is open to the X side. The receiving members 13 on −Z and Z sides are substantially symmetrical with respect to the center of the apparatus body 11 in the Z direction. Thus, FIG. 2 illustrates the receiving member 13 on the −Z side and omits the illustration of the receiving member 13 on the Z side. Each receiving member 13 includes, for example, a bottom wall 32, an inner wall 34, and a side wall 36.

The bottom wall 32 has a shape of a rectangle having its length in the X direction and its width in the Z direction. The inner wall 34 stands erect in the Y direction from the −X side end portion of the bottom wall 32. A stud 34A, extending toward the X side, is disposed on the inner wall 34. The side wall 36 stands erect in the Y direction from the −Z side end portion of the bottom wall 32.

A side plate 37 extending in the X-Y plane is disposed on the Z side of the Z side end portion of the bottom wall 32 and the Z side end portion of the inner wall 34. The side plate 37 includes a portion extending toward the −Y side from the Z side end portion of the bottom wall 32, and a portion extending toward the −X side from the Z side end portion of the inner wall 34. A front plate 38 extending in the Y-Z plane is disposed on the −Y side of the X side end portion of the bottom wall 32. The front plate 38 extends toward the −Y side from the X side end portion of the bottom wall 32. The front plate 38 has a through hole 39, extending through the front plate 38 in the X direction. A stud 59 (see FIG. 4), described below, is inserted into the through hole 39 from the X side of the front plate 38. The side plate 37 and the front plate 38 are integrated together.

The side plate 37 has a hole 42 and a cut 44 at a portion on the −X side of the inner wall 34. The hole 42 extends through the side plate 37 in the Z direction. The hole 42 extends longer in the X direction than in the Y direction. The cut 44 is disposed on the Y side of the hole 42. For example, the cut 44 has a U shape that is open to the X side when viewed in the Z direction.

A support pin 46 and a support pin 47 are disposed on the side plate 37 (apparatus body 11). For example, the support pins 46 and 47 have a cylindrical shape of the same size. The support pin 46 extends from the side plate 37 to the Z side from a portion on the −Y side of the hole 42 while having its axis extending in the Z direction. The support pin 47 extends from the side plate 37 to the Z side from a portion on the −Y side of the bottom wall 32 while having its axis extending in the Z direction. The support pins 46 and 47 have their attachment heights in the Y direction aligned with each other and are arranged in the X direction. The support pins 46 and 47 are disposed to guide a link member 56, described below, in the X direction.

Figure 4:
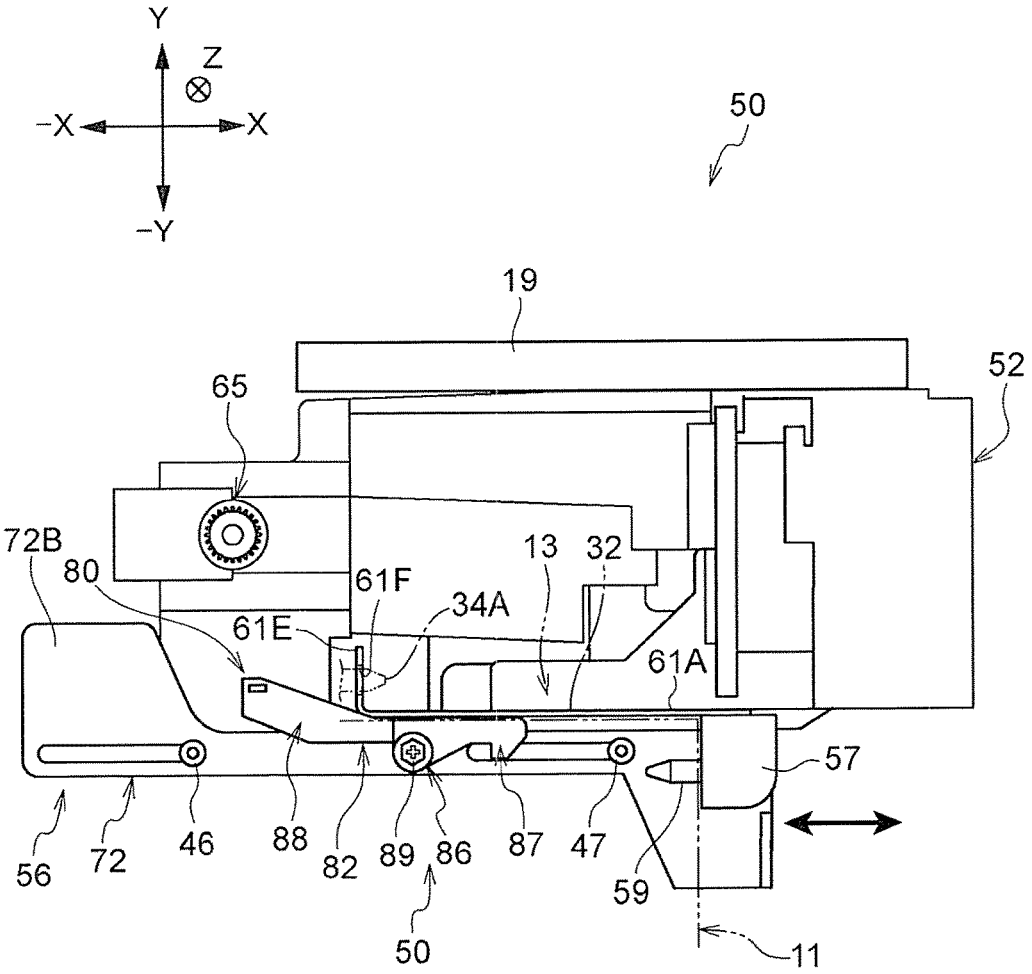
FIG. 4 is a side view of the fixing unit and the link member according to the first exemplary embodiment.

A coil spring, which is not illustrated and presses a fixing unit 52 away (to the X side), is disposed at a portion of the apparatus body 11 illustrated in FIG. 4 on the −X side of the receiving member 13. The fixing unit 52 is described below. A guide member 19 is disposed on the Y side of the receiving member 13. The guide member 19 has a shape of a plate having a thickness in the Y direction and extending in the X direction and the Z direction. When the fixing unit 52 is to be attached to the receiving member 13, the guide member 19 comes into contact with an Y-side upper surface of the fixing unit 52 to guide the fixing unit 52 in the X direction. Hereinbelow, the illustration and the description of the guide member 19 may be omitted.

Structure of Related Portion

The removable structure 50 is described now.

The removable structure 50 illustrated in FIG. 2 includes a fixing unit 52, a coupling member 54, a link member 56, and a holding portion 80. The fixing unit 52 is an example of an assembly. The coupling member 54 is an example of a connection member. The link member 56 is an example of a switch member. The holding portion 80 is an example of a holding device.

Fixing Unit

Figure 3:
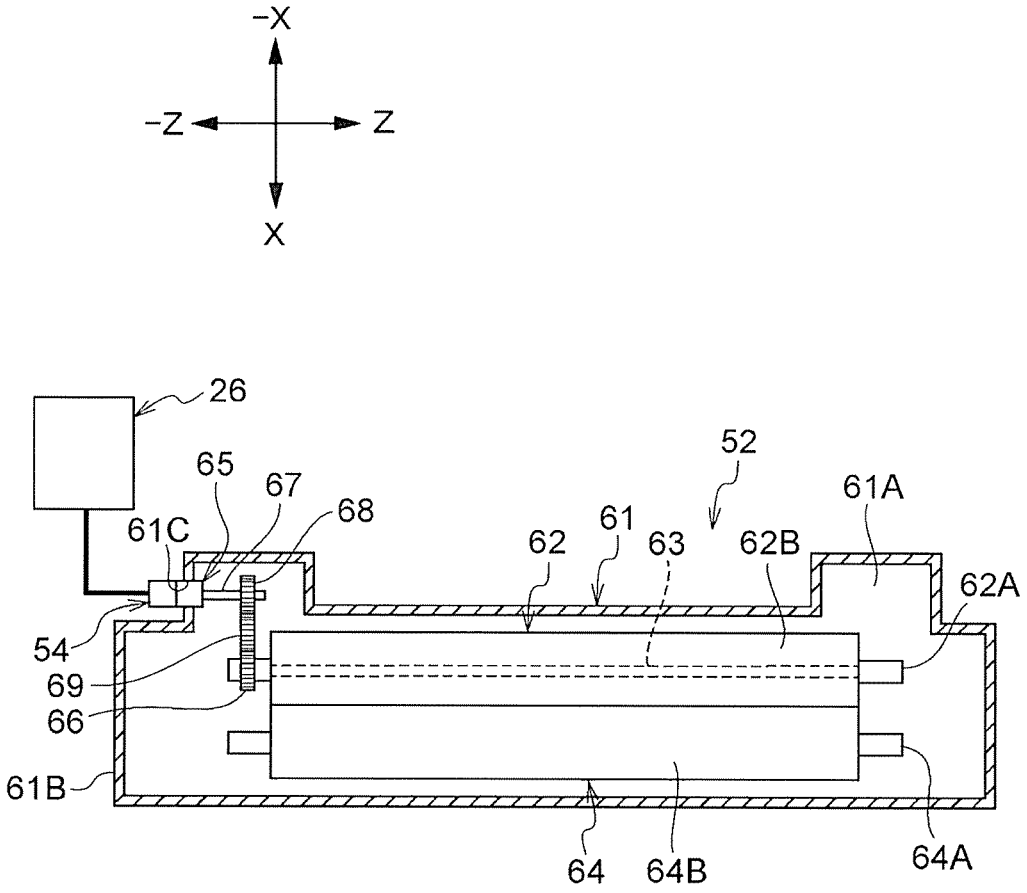
FIG. 3 illustrates an internal structure of the fixing unit according to the first exemplary embodiment.

The fixing unit 52 illustrated in FIG. 3 includes a housing 61, a fixing roller 62, which is an example of a rotator, a halogen heater 63, a pressing roller 64, and a coupling member 65, which is an example of a connectable member. The fixing unit 52 is longer in the Z direction than in the X direction.

The housing 61 has a rectangular parallelepiped box shape extending in the Z direction. The housing 61 includes a bottom portion 61A, extending longer in the Z direction than in the X direction when viewed in the Y direction, and a side portion 61B, standing erect in the Y direction at the −Z side end portion of the bottom portion 61A. The side portion 61B has a through hole 61C, which extends through in the Z direction. The housing 61 has both end portions in the Z direction protruding further to the −X side than the center portion in the Z direction.

Figure 5:
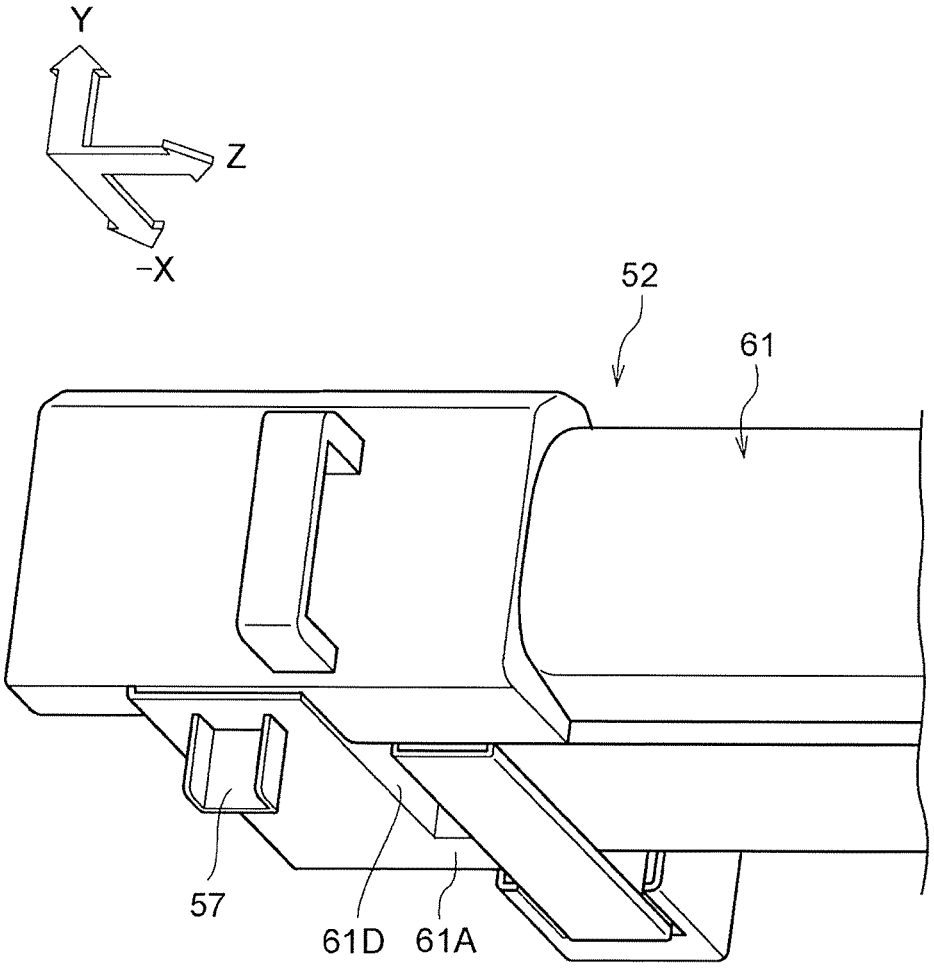
FIG. 5 is a perspective view of a bottom portion of the fixing unit according to the first exemplary embodiment.

The bottom portion 61A illustrated in FIG. 5 has recesses 61D, set back to the Y side, on both end portions of the bottom portion 61A in the Z direction. Brackets 57 are disposed on the outer sides, in the Z direction, of the recesses 61D of the bottom portion 61A. When viewed in the Y direction, each bracket 57 has a U-shaped cross section that is open to the X side. Each bracket 57 includes a stud 59 (see FIG. 4), protruding from the bracket 57 to the −X side having an axis extending in the X direction.

At a portion of the bottom portion 61A illustrated in FIG. 4, a wall portion 61E, standing erect in the Y direction, is disposed. The wall portion 61E has a through hole 61F having an axis extending in the X direction. When the fixing unit 52 is attached to the receiving member 13, the stud 34A is inserted into the through hole 61F.

The fixing roller 62 illustrated in FIG. 3 includes, for example, a cylindrical core bar 62A and a coating portion 62B on the outer circumferential surface of the cylindrical core bar 62A. The coating portion 62B includes an elastic layer and a release layer. The fixing roller 62 is disposed on the −X side of the transport path A (see FIG. 1) in the housing 61 to be rotatable about the axis extending in the Z direction. The halogen heater 63 is disposed in the core bar 62A so as not to come into contact with the core bar 62A.

The halogen heater 63 generates heat with energization to heat the fixing roller 62. A gear 66 is attached to the core bar 62A on the outer circumference of the −Z side end portion. The fixing roller 62 has its temperature detected by a temperature sensor, not illustrated. When the temperature sensor detects a temperature lower than a predetermined temperature, the halogen heater 63 is energized. When the temperature sensor detects a temperature higher than or equal to the predetermined temperature, the halogen heater 63 is stopped being energized.

For example, the pressing roller 64 includes a cylindrical core bar 64A and a coating portion 64B on the outer circumferential surface of the cylindrical core bar 64A. The coating portion 64B includes an elastic layer and a release layer. The pressing roller 64 is disposed in the housing 61 on the X side of the transport path A (see FIG. 1) to be rotatable about the axis extending in the Z direction. The pressing roller 64 is movable by a retract mechanism, not illustrated and including a spring, between a pressing position, at which it presses the fixing roller 62, and a retract position, at which it is spaced from the fixing roller 62. The pressing roller 64 forms a nip while having its outer circumferential surface pressing the outer circumferential surface of the fixing roller 62.

The coupling member 65 is cylindrical and disposed in the housing 61 to be rotatable about the axis extending in the Z direction relative to the side portion 61B. The coupling member 65 includes multiple protrusions, not illustrated, at intervals in the circumferential direction on the outer circumferential surface of the coupling member 65 at a portion coupled with the coupling member 54. The coupling member 65 has its −Z side end portion exposed to the outside of the housing 61 through the through hole 61C. A rotation shaft 67 is attached to the Z side end portion of the coupling member 65.

A gear 68 is attached to the rotation shaft 67. The gear 68 transmits a rotational force to the gear 66 via a gear 69. Thus, the fixing roller 62 is rotated when the coupling member 54 is rotated. The fixing roller 62 is thus rotated by the rotational force transmitted from the driver 26 via the coupling member 54 and the coupling member 65, described below, and fixes the toner image G (see FIG. 1) to the sheet P.

The fixing unit 52 illustrated in FIG. 2 is attached to the receiving member 13 from the X side to the −X side in the X direction and removed toward the X side. In the present exemplary embodiment, an example of a first direction is the X direction, and an example of a cross direction is the Z direction.

When the fixing unit 52 is attached to the receiving member 13 in the X direction, the stud 34A is inserted into the through hole 61F (see FIG. 4) of the fixing unit 52, and the stud 59 (see FIG. 4) is inserted into the through hole 39. In this state, the fixing unit 52 is restricted from moving in the Z direction and the Y direction.

Coupling Member

The coupling member 54 illustrated in FIG. 2 has, for example, a cylindrical shape having its axis extending in the Z direction. The coupling member 54 has an annular contact surface 55 when viewed from the Z side in the Z direction. The coupling member 54 is rotatable in the apparatus body 11 about the axis extending in the Z direction. The coupling member 54 is capable of moving forward to the Z side of the side plate 37 in the Z direction and moving away to the −Z side of the side plate 37 in the Z direction through the cut 44 of the apparatus body 11. The coupling member 54 is pressed to the Z side by a coil spring, not illustrated.

The coupling member 54 has multiple recesses, not illustrated and spaced at intervals in the circumferential direction. These recesses are engaged with protrusions, not illustrated, of the coupling member 65 (see FIG. 3) when the coupling member 54 changes its relative position in the Z direction. Specifically, the coupling member 54 is connected to the coupling member 65 when moved forward. The coupling member 54 transmits a rotational force to the coupling member 65 when driven to rotate by the driver 26 (see FIG. 3).

Link Member

The link member 56 illustrated in FIG. 2 includes, for example, a first link member 72, disposed on the Z side of the side plate 37, and a second link member 74, disposed on the −Z side of the side plate 37 and fixed to the first link member 72.

Figure 6:
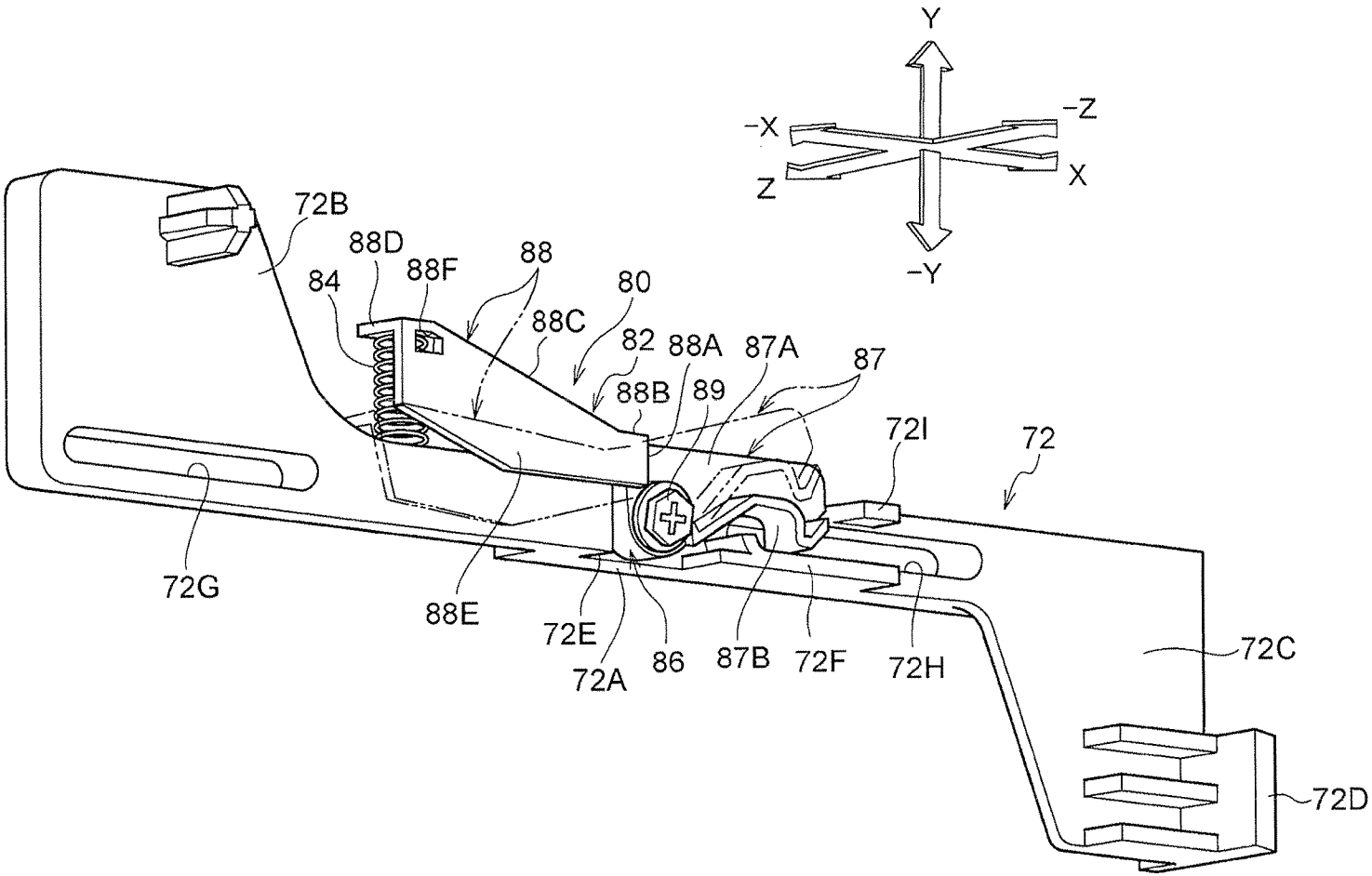
FIG. 6 is a perspective view of the link member according to the first exemplary embodiment.

The first link member 72 illustrated in FIG. 6 includes, for example, a lengthwise portion 72A, an upright portion 72B, a sag portion 72C, a front plate portion 72D, a crank portion 72E, an overhanging portion 72F, and a guide portion 72I. The lengthwise portion 72A is an angular prism having an axis extending in the X direction and longer in the X direction than in the Z direction. The lengthwise portion 72A has a long hole 72G, extending in the X direction and extending through in the Z direction, at a −X side portion. The lengthwise portion 72A has a long hole 72H, extending in the X direction and extending through in the Z direction, at an X-direction center portion.

As illustrated in FIG. 2, the long hole 72G receives the support pin 46. The long hole 72H receives the support pin 47. Thus, the first link member 72 is supported and guided (moved) in the X direction by the support pins 46 and 47.

The upright portion 72B illustrated in FIG. 6 stands erect to the Y side at the −X side end portion of the lengthwise portion 72A. The upright portion 72B faces the hole 42 (see FIG. 2) of the side plate 37 in the Z direction while the lengthwise portion 72A is supported by the support pins 46 and 47 (see FIG. 2). The sag portion 72C is a portion sagging to the −Y side at the X side portion of the lengthwise portion 72A. The front plate portion 72D is a plate member extending to the Z side and the −Z side from the X side end portions of the lengthwise portion 72A and the sag portion 72C. When the front plate portion 72D is viewed in the X direction, the front plate portion 72D has, for example, an L shape.

A crank portion 72E is, for example, disposed between the long holes 72G and 72H in the lengthwise portion 72A. When viewed in the Y direction, the crank portion 72E is cranked so that the portion on the X side protrudes to the Z side beyond the portion on the −X side. A shaft portion, not illustrated, is disposed at a portion of the lengthwise portion 72A between the crank portion 72E and the long hole 72H. The shaft portion has a cylindrical shape having an axis extending in the Z direction and has a screw hole to which a bolt 89, described below, is fastened. The shaft portion protrudes from the lengthwise portion 72A to the X side.

The overhanging portion 72F extends to the −Z side from a −Y side portion of the peripheral portion of the long hole 72H in the lengthwise portion 72A. The overhanging portion 72F has a plate shape having a thickness in the Y direction. When a hook portion 87 of a lock member 82, described below, comes into contact with the Y side of the overhanging portion 72F, the overhanging portion 72F restricts rotation of the lock member 82.

The guide portion 72I extends to the −Z side from the Y side portion of the peripheral portion of the long hole 72H in the lengthwise portion 72A. The guide portion 72I has a plate shape having a thickness in the Y direction. The guide portion 72I has a Y-side upper portion flatly extending in the X-Z plane. The guide portion 72I allows part of the fixing unit 52 (see FIG. 2) to be placed on its upper surface to guide the fixing unit 52 in the X direction.

The second link member 74 illustrated in FIG. 2 includes, for example, a leg 74A and a cam 74B. The leg 74A is fixed to the upright portion 72B through the hole 42 and extends in the Y direction. The cam 74B extends from the Y side end portion (upper end portion) of the leg 74A to the X side in the X direction. The cam 74B has a long hole 74C extending through in the Z direction and extending in the X direction.

The long hole 74C has a size appropriate for the distance by which the link member 56 needs to move for the coupling member 54 to move forward in the Z direction. Specifically, the long hole 74C has a dimension in the X direction that is longer than or equal to twice the dimension (diameter) of the coupling member 54 in the X direction and longer than the distance in the X direction from a second position to a first position of the link member 56.

At the −Z side edge of the long hole 74C in the cam 74B, a flat portion 76A extending in the X direction is disposed on the X side of the center in the X direction, and an overhanging portion 76B projecting to the −Z side is disposed on the −X side. The flat portion 76A and the overhanging portion 76B are connected together by an inclined portion 76C. While the overhanging portion 76B and the contact surface 55 of the coupling member 54 are in contact with each other, the coupling member 54 retracts away from the coupling member 65 (see FIG. 3). The position of the link member 56 in the retracted state is referred to as the second position.

On the other hand, while the flat portion 76A and the contact surface 55 are in contact with each other, the coupling member 54 is in the projecting state, that is, connected to the coupling member 65 (see FIG. 3). The position of the link member 56 in the projecting state is referred to as the first position. The first position is closer to the rear side (−X side) of the apparatus body 11 than the second position.

The position of the link member 56 is switched in the X direction. The link member 56 is switched between the first position and the second position by being moved in the X direction. The link member 56 is moved independently of the covering 12 (see FIG. 1). Moved independently here refers to the case where the link member 56 is not moved by the force for operating the covering 12 and that the covering 12 is not moved by an operation of the link member 56.

Holding Portion

The holding portion 80 includes the above-described support pin 47, which is an example of a body member and a guide member, a lock member 82, which is an example of a hook member, and a coil spring 84, which is an example of a pressing member.

Lock Member

The lock member 82 includes, for example, a coupling portion 86, which is connected to the first link member 72 to be rotatable about its axis extending in the Z direction, a hook portion 87, extending from the coupling portion 86 to the X side, and a release portion 88, extending from the coupling portion 86 to the −X side.

The coupling portion 86 has a plate shape having a thickness in the Z direction. The thickness of the coupling portion 86 in the Z direction is about the same as the dimension of the crank portion 72E in the Z direction. The coupling portion 86 has a through hole, not illustrated and extending through the coupling portion 86 in the Z direction. The through hole receives the above-described shaft portion disposed at the lengthwise portion 72A of the first link member 72. In the state where the coupling portion 86 is disposed on the −Z side of a portion of the lengthwise portion 72A between the crank portion 72E and the long hole 72H, the shaft portion, not illustrated, of the lengthwise portion 72A is inserted into the through hole of the coupling portion 86 and a safety bolt 89 is fastened to the screw hole of the shaft portion. Thus, the coupling portion 86 is rotatable about its axis extending in the Z direction, around the shaft portion of the lengthwise portion 72A. In other words, the coupling portion 86 is rotatable in the X-Y plane relative to the first link member 72.

The hook portion 87 includes, for example, a plate portion 87A and a recess 87B. The plate portion 87A extends from the coupling portion 86 to the X side in the X-Y plane. The recess 87B extends to the −Z side from the −Y side end portion of the plate portion 87A to form a flange. The recess 87B has a trapezoidal shape having a X-direction center portion set back to the Y side (open to the −Y side). The X side end portion of the recess 87B is bent back into a V shape so as to protrude to the −Y side when viewed in the Z direction. The recess 87B has a size with which the inner wall surface of the recess 87B and the outer peripheral surface of the support pin 47 (see FIG. 2) come into contact with each other in the X direction and the Y direction. As described above, the hook portion 87, when hooked on the Y side of the support pin 47, holds the link member 56 in the second position. When the hook portion 87 is hooked on the support pin 47, the plate portion 87A has its upper surface disposed at substantially the same level as the upper surface of the first link member 72 to extend in the X-Z plane.

The release portion 88 illustrated in FIG. 2 includes, for example, a front wall 88A, an upper wall 88B, an inclined wall 88C, an upper wall 88D, and a side wall 88E (see FIG. 6). The arrangement of components of the release portion 88 is described in the state where the hook portion 87 (see FIG. 6) is hooked on the support pin 47 and the link member 56 is held in the second position.

The front wall 88A extends from the coupling portion 86 to the −Z side to be in a rectangular plate shape extending in the Y-Z plane. The front wall 88A is disposed on the X side of the crank portion 72E (see FIG. 6). The upper wall 88B extends in the X direction to the −X side from the Y side end portion of the front wall 88A. The inclined wall 88C extends obliquely upward from the −X side end portion of the upper wall 88B to have its −X side portion located closer to the Y side than its X side portion. The upper wall 88D extends in the X direction to the −X side from the −X side end portion of the inclined wall 88C. When viewed in the Y direction, the upper wall 88B, the inclined wall 88C, and the upper wall 88D cover the portion of the lengthwise portion 72A of the first link member 72 on the −X side of the crank portion 72E.

The side wall 88E illustrated in FIG. 6 has a plate shape extending to the −Y side from the −Z side end portions of the upper wall 88B, the inclined wall 88C, and the upper wall 88D. The side wall 88E is disposed in the X-Y plane. The X side end portion of the side wall 88E is connected to the −Z side end portion of the front wall 88A. The side wall 88E has a through hole 88F, extending through the side wall 88E in the Z direction, at the −X side end portion of the side wall 88E. The side wall 88E is disposed on the −Z side of a portion of the lengthwise portion 72A of the first link member 72 on the −X side of the crank portion 72E. The release portion 88 releases the hooked hook portion 87 when rotated as a result of coming into contact with the bottom portion 61A (see FIG. 5) of the fixing unit 52.

Coil Spring

In the state where the lock member 82 is coupled with the first link member 72, the coil spring 84 is held between the upper wall 88D and the upper surface of the lengthwise portion 72A to expand or contract in the Y direction. The coil spring 84 has its one end portion hooked on the through hole 88F of the side wall 88E. When viewed in the Z direction, the coil spring 84 presses the release portion 88 toward the Y side so that the release portion 88 moves to the Y side about the coupling portion 86 and so that the hook portion 87 moves to the −Y side about the coupling portion 86. In other words, the coil spring 84 presses the lock member 82 so that the hook portion 87 rotates in a direction in which it is hooked on the support pin 47 (see FIG. 2).

In the state where the fixing unit 52 is removed from the receiving member 13, the holding portion 80 holds the link member 56 in the second position. Specifically, when the link member 56 is placed in the second position, the holding portion 80 holds the link member 56 in the second position with an operation of removing the fixing unit 52 from the receiving member 13. The holding portion 80 releases the held link member 56 with an operation of attaching the fixing unit 52 to the receiving member 13.

Operation

The operation of the first exemplary embodiment is described now.

Attachment of Fixing Unit

Figure 7:
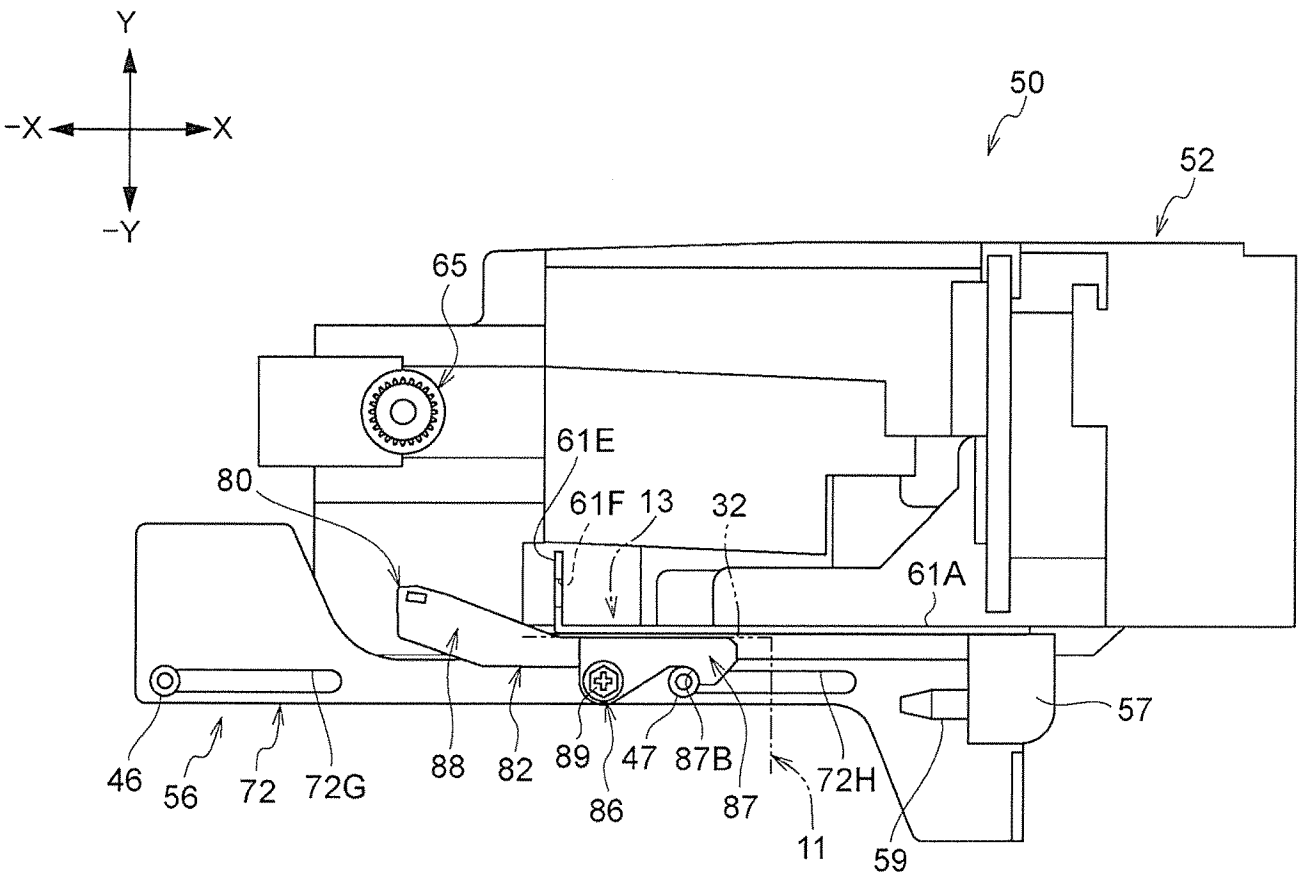
FIG. 7 illustrates the link member according to the first exemplary embodiment in the second position and the fixing unit in the state of not being attached to the receiving member.

As illustrated in FIG. 7, the link member 56 is held in the second position before the fixing unit 52 is attached to the receiving member 13. The process that the link member 56 goes through until being held is described later. In this state, the fixing unit 52 has its part placed on the bottom wall 32 of the receiving member 13 and slid (moved) to the −X side. Here, the upper surfaces of the coupling portion 86 and the hook portion 87 of the lock member 82 extend in the X direction. In this structure, the lock member 82 does not restrict movement of the fixing unit 52 when the fixing unit 52 is slid to the −X side. On the other hand, the release portion 88 of the lock member 82, disposed on the Y side of the coupling portion 86 and the hook portion 87, comes into contact with the bottom portion 61A of the slid fixing unit 52.

Figure 8:
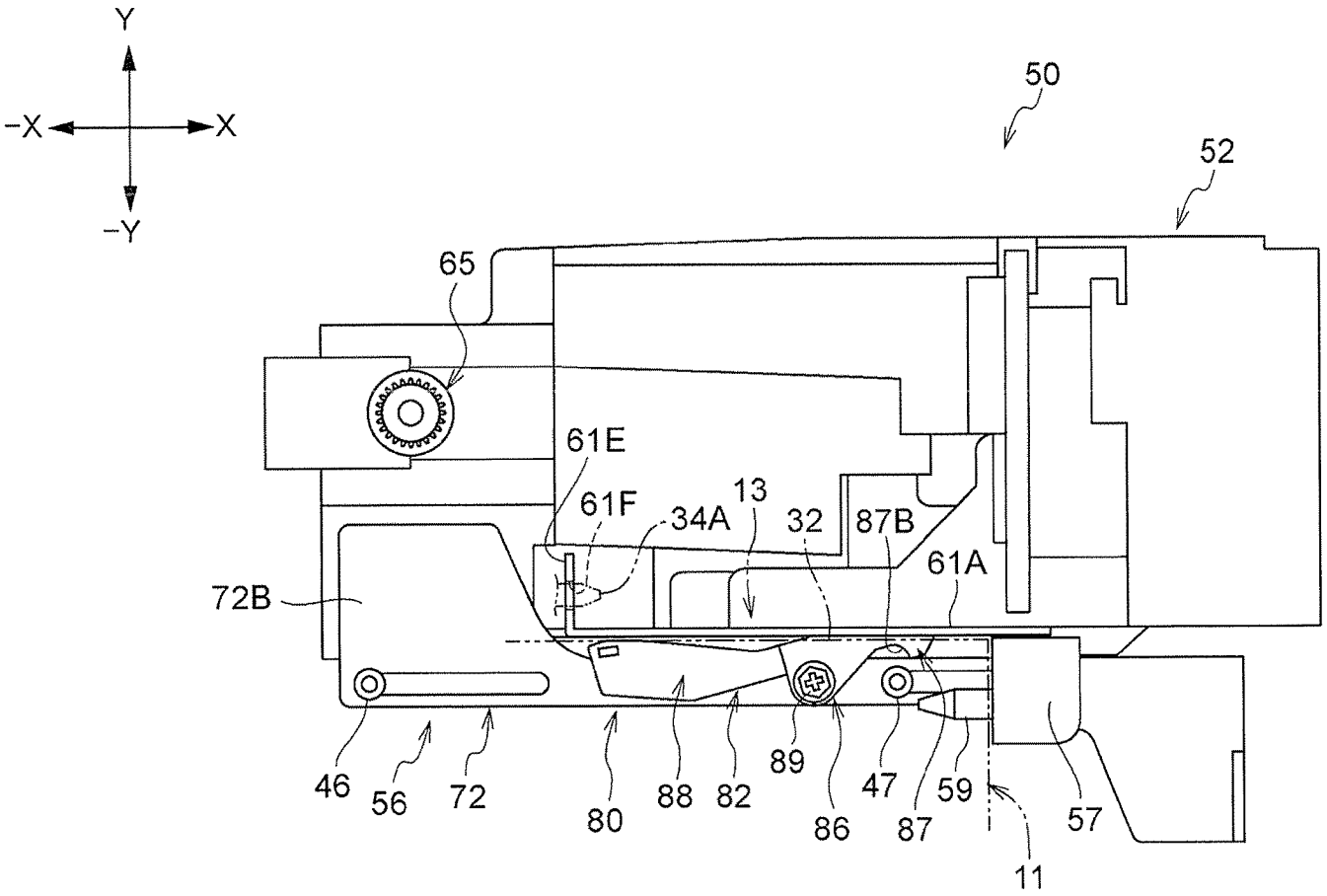
FIG. 8 illustrates the link member according to the first exemplary embodiment in the second position and the fixing unit in the state of being attached to the receiving member.

Subsequently, as illustrated in FIG. 8, the wall portion 61E of the fixing unit 52 comes into contact with the X side of the release portion 88 and moves to the −X side against the pressing force of the coil spring 84 (see FIG. 6). Thus, the lock member 82 rotates about the coupling portion 86. Here, the lock member 82 rotates for the release portion 88 to move to the −Y side and for the hook portion 87 to move to the Y side. Thus, the hook portion 87 becomes separated from the support pin 47, and the held link member 56 is released to be switchable to the first position (−X side).

The fixing unit 52 moves to the −X side while moving the release portion 88 to the −Y side. The hook portion 87 that has moved (rotated) to the Y side enters a recess 61D (see FIG. 5) of the fixing unit 52. Thus, the movement of the fixing unit 52 to the −X side is not restricted by the lock member 82. Subsequently, the stud 59 is inserted into the through hole 39 (see FIG. 2) of the front plate 38, and the stud 34A is inserted into the through hole 61F, so that the fixing unit 52 is attached to the receiving member 13.

Subsequently, as illustrated in FIG. 4, the coupling member 54 (see FIG. 2) is connected to the coupling member 65 as a result of the link member 56 being switched to the first position. At this time, the lock member 82 rotates in a direction in which the hook portion 87 lowers to the −Y side as a result of the hook portion 87 coming into contact with the −X side edge portion of the bottom portion 61A. The upper surfaces of the coupling portion 86 and the hook portion 87 extend in the X direction. The release portion 88 is disposed on the −X side of the wall portion 61E and to the Y side of the coupling portion 86 and the hook portion 87.

Removal of Fixing Unit

In the state, illustrated in FIG. 4, where the fixing unit 52 is attached, the link member 56 is switched to the second position (the X side). Here, the lock member 82 rotates in a direction in which the release portion 88 lowers to the −Y side as a result of the release portion 88 coming into contact with the bottom portion 61A and being moved to the X side. Thus, the hook portion 87 rises to the Y side and enters the recess 61D (see FIG. 5) of the fixing unit 52. At this time, the recess 87B of the hook portion 87 is disposed on the Y side of the support pin 47.

Subsequently, as illustrated in FIG. 7, when the fixing unit 52 is moved to the X side to be removed from the receiving member 13, the bottom portion 61A comes into contact with the hook portion 87 from the −X side to the X side. Thus, the lock member 82 rotates in a direction in which the hook portion 87 lowers to the −Y side, and the recess 87B comes into contact with the outer peripheral surface of the support pin 47. Specifically, the hook portion 87 is hooked on the support pin 47.

Here, the moment of the pressing force from the coil spring 84 (see FIG. 6) is exerted on the support pin 47. Thus, in the state where the fixing unit 52 is removed, the hook portion 87 is not moved to the Y side relative to the support pin 47. The hook portion 87 has its movement to the −X side restricted by coming into contact with the support pin 47. The movement of the hook portion 87 to the X side is restricted as a result of the support pins 47 and 48 and the inner wall surfaces of the long holes 72G and 72H coming into contact with each other. The link member 56 is thus held in the second position by the holding portion 80 while the fixing unit 52 is removed, so that the link member 56 is prevented from being moved to the first position.

As described above, in a removable structure 50, the holding portion 80 holds the link member 56 in the second position while the fixing unit 52 is removed from the receiving member 13. Thus, to attach the fixing unit 52 to the receiving member 13 another time, the fixing unit 52 is attached to the receiving member 13 while the coupling member 54 (see FIG. 2) is retracted from the coupling member 65. Thus, the fixing unit 52 is prevented from being attached to the receiving member 13 while the coupling member 54 is in the projecting state.

In the removable structure 50, the link member 56 is held in the second position with an operation of removing the fixing unit 52 from the receiving member 13. Specifically, the removal of the fixing unit 52 is interlinked with the operation of the holding portion 80 (lock member 82) for holding the link member 56. This structure further simplifies holding of the link member 56 than the structure in which the removal of the fixing unit 52 from the receiving member 13 is performed independently of holding of the link member 56.

In the removable structure 50, the held link member 56 is released with an operation of attaching the fixing unit 52 to the receiving member 13. Specifically, an attachment of the fixing unit 52 is interlinked with an operation of the holding portion 80 (lock member 82) for releasing the held link member 56. This structure further simplifies release of the held link member 56 than the structure in which the attachment of the fixing unit 52 to the receiving member 13 is performed independently of release of the held link member 56.

In addition, the lock member 82 of the holding portion 80 is coupled with (included in) the link member 56 in the removable structure 50. In a comparative example having a structure including the lock member 82 disposed on a component different from the link member 56, the area over which the link member 56 moves differs from the area over which the lock member 82 moves. This structure hinders the lock member 82 and the link member 56 from being interlinked together. In the removable structure 50, on the other hand, the lock member 82 is disposed on the link member 56, and the area over which the link member 56 moves is closer to the area over which the lock member 82 moves than in the case of the comparative example. This structure facilitates interlinking of the lock member 82 and the link member 56 with each other.

In the removable structure 50, the coil spring 84 (see FIG. 6) presses the lock member 82 toward the Y side for the hook portion 87 to rotate in a direction in which it is hooked on the support pin 47. This structure hinders the hook portion 87 from being removed from the support pin 47 than the structure that holds the lock member 82 in a hooked state using only the mass of the lock member 82. This structure thus prevents the hooked lock member 82 from being released while the fixing unit 52 is removed.

In the removable structure 50, the support pin 47 also serves as a guide member that guides the link member 56 in the X direction. This structure reduces the number of components compared to the structure including the support pin 47 and a guide member as separate members.

In the removable structure 50, the link member 56 has its position switched in the X direction. The first position is located closer to the rear side (−X side) of the apparatus body 11 than the second position. Thus, the link member 56 is pushed to the −X side to connect the coupling member 54 to the coupling member 65. This structure needs a smaller space between the fixing unit 52 and a covering 12 (see FIG. 1) in a closed state than the structure in which the first position is disposed closer to the front side than the second position. The apparatus body 11 thus has a smaller size.

In the image forming apparatus 10, the rotational force caused in the driver 26 is transmitted to the fixing roller 62 (see FIG. 3) via the coupling members 54 and 65 (see FIG. 3). In the removable structure 50, the coupling members 54 and 65 are prevented from being degraded. This structure thus further reduces variation of the rotational force transmitted to the fixing roller 62 than the structure not including the removable structure 50. This structure thus prevents the fixed toner from being displaced from a predetermined fixed position on the sheet P and reduces defects of the toner image G.

Second Exemplary Embodiment

An assembly removable structure and an image forming apparatus according to a second exemplary embodiment are described now as examples. Components or portions basically the same as those of the first exemplary embodiment are denoted with the reference signs the same as those of the first exemplary embodiment and not described.

Figure 9:
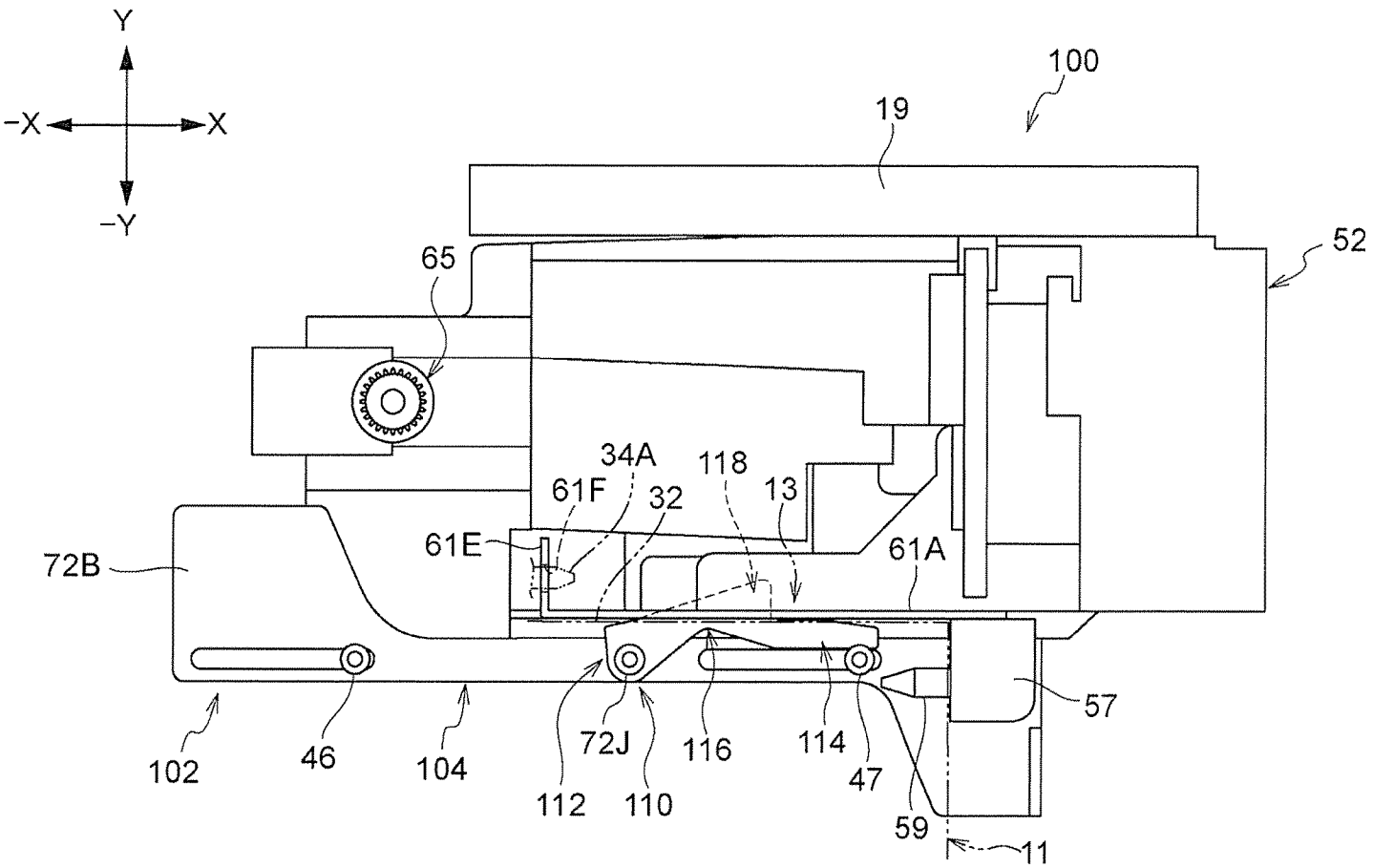
FIG. 9 is a side view of a fixing unit and a link member according to a second exemplary embodiment.

FIG. 9 illustrates a removable structure 100, which is an example of the assembly removable structure according to the second exemplary embodiment. The removable structure 100 is provided instead of the removable structure 50 (see FIG. 2) of the image forming apparatus 10 (see FIG. 1) according to the first exemplary embodiment. The removable structure 100 includes a fixing unit 52, a coupling member 54 (see FIG. 2), a link member 102, and a restricting portion 110. The link member 102 is an example of a switch member. The restricting portion 110 is an example of a restricting device. An apparatus body 11 includes a guide member 19, as in the case of the first exemplary embodiment.

Link Member

Figure 10:
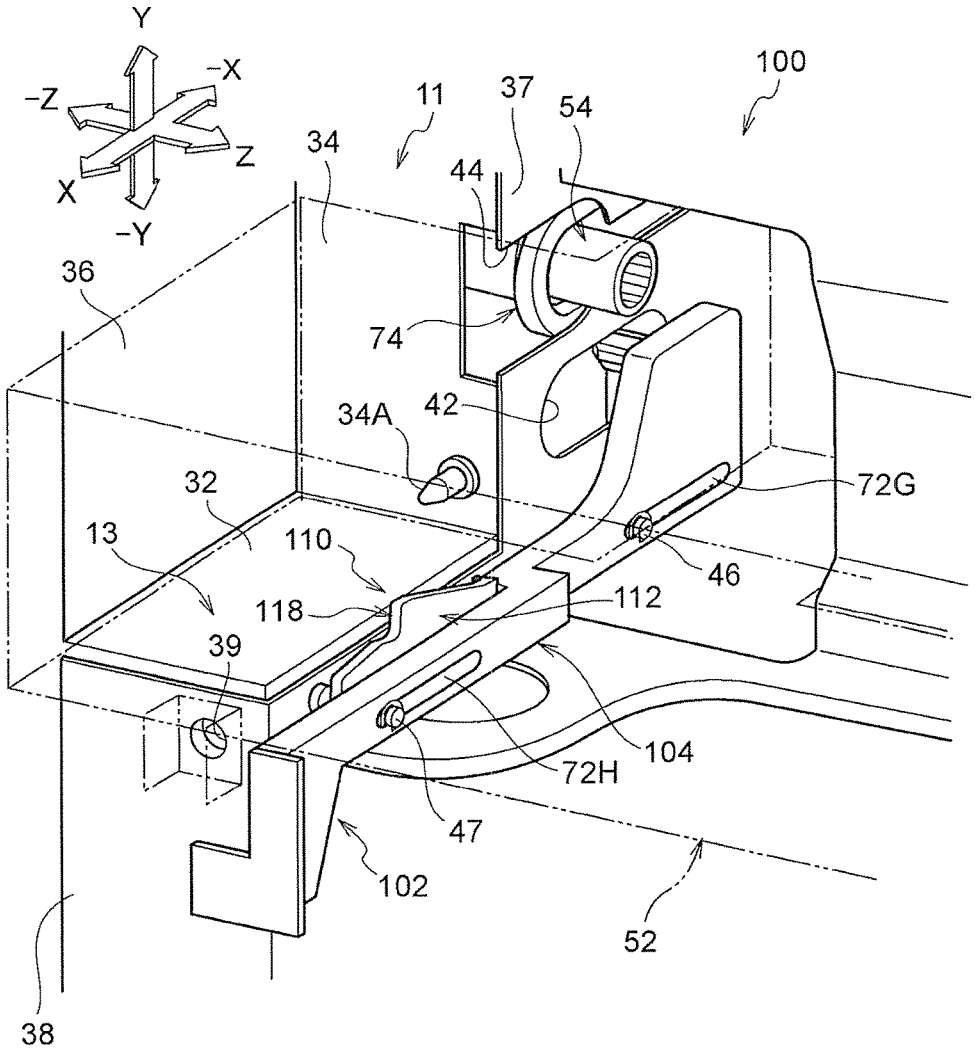
FIG. 10 illustrates the link member according to the second exemplary embodiment in the first position and a coupling member in a projecting state.

For example, the link member 102 illustrated in FIG. 10 includes a first link member 104, disposed on the Z side of the side plate 37, and a second link member 74, disposed on the −Z side of the side plate 37 and fixed to the first link member 104.

Figure 11:
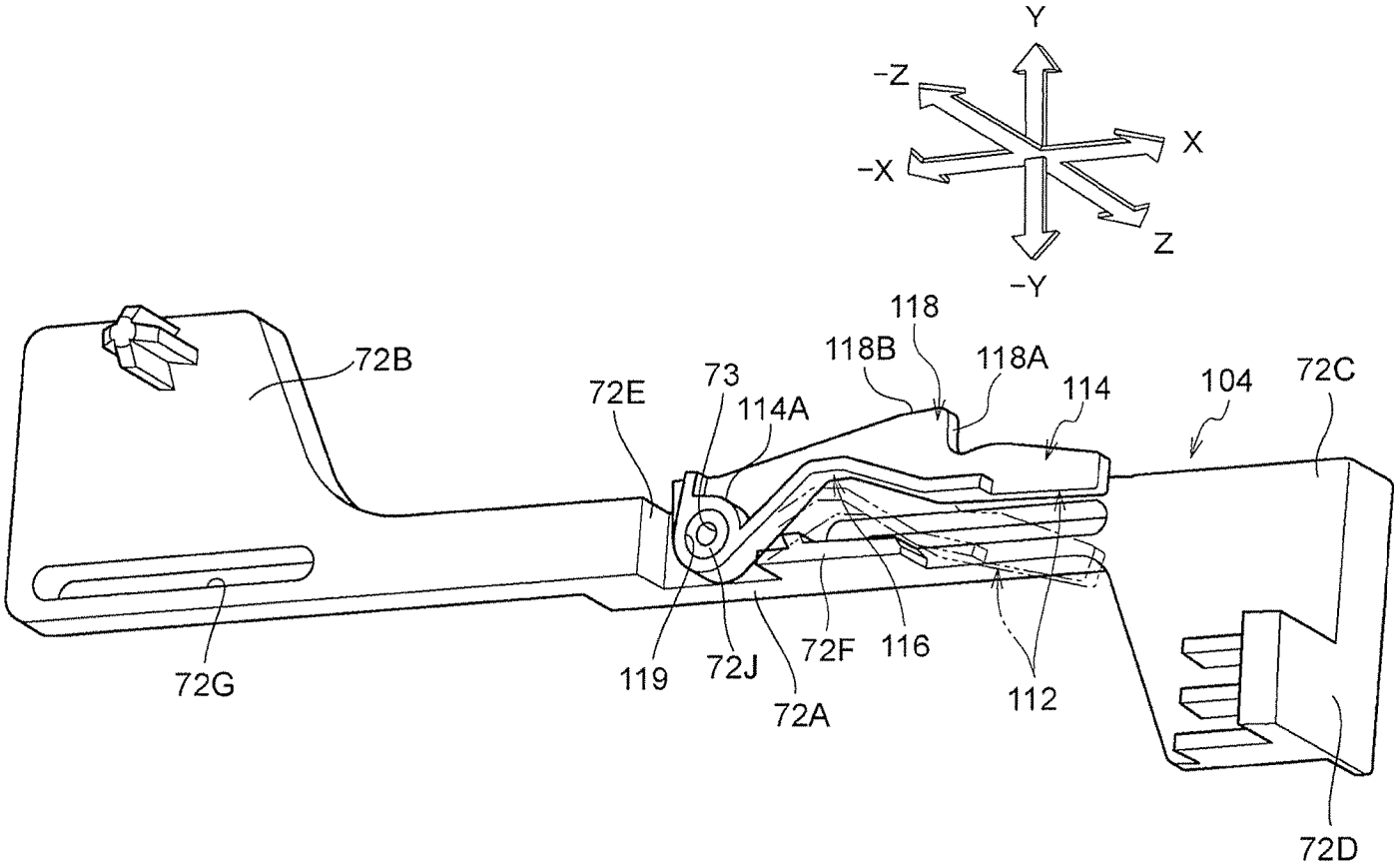
FIG. 11 is a perspective view of the link member according to the second exemplary embodiment.

The first link member 104 illustrated in FIG. 11 has, for example, a structure excluding the guide portion 72I (see FIG. 2) from the first link member 72 (see FIG. 2) according to the first exemplary embodiment. In other words, the first link member 104 and the first link member 72 have the same structure except for the guide portion 72I. Specifically, the first link member 104 includes a lengthwise portion 72A, an upright portion 72B, a sag portion 72C, a front plate portion 72D, a crank portion 72E, and an overhanging portion 72F.

The lengthwise portion 72A has a long hole 72G and a long hole 72H. Between the crank portion 72E and the overhanging portion 72F of the first link member 104, a shaft portion 72J protrudes to the −Z side from the lengthwise portion 72A. The shaft portion 72J has a cylindrical shape having an axis extending in the Z direction. The shaft portion 72J has a screw hole 73.

As illustrated in FIG. 10, the long hole 72G receives the support pin 46. The long hole 72H receives the support pin 47. Thus, the first link member 104 is supported and guided (moved) in the X direction by the support pins 46 and 47.

The position of the link member 102 when the coupling member 54 is in a retracted state apart from the coupling member 65 (see FIG. 3) is referred to as a second position. On the other hand, the position of the link member 102 when the coupling member 54 is in a projecting state and connected to the coupling member 65 is referred to as a first position. The first position is closer to the rear side (−X side) of the apparatus body 11 than the second position.

As described above, the link member 102 has its position switched in the X direction. The link member 102 is moved in the X direction to be switched between the first position and the second position. The link member 102 is operated independently of the covering 12 (see FIG. 1). Operated independently here refers to the case where the link member 102 is not moved with the force for operating the covering 12 and that the covering 12 is not moved when the link member 102 is operated.

Restricting Portion

The restricting portion 110 illustrated in FIG. 10 includes the above-described support pin 47, which is an example of a body member and a guide member, and a stopper member 112, which is an example of a coupling member.

Stopper Member

The stopper member 112 illustrated in FIG. 11 includes, for example, an arm 114, coupled to the first link member 104 to be rotatable about its axis extending in the Z direction and including a recess 116 and a protrusion 118.

The arm 114 has a plate shape extending in the X direction and having a thickness in the Z direction. The arm 114 has a thick portion 114A at the −X side end portion. The thick portion 114A has a thickness in the Z direction equivalent to the dimension of the crank portion 72E in the Z direction. The thick portion 114A has a through hole 119, extending through the thick portion 114A in the Z direction. The through hole 119 receives the shaft portion 72J of the first link member 104.

The shaft portion 72J is inserted into the through hole 119 and a screw, not illustrated, is fastened to the screw hole 73 of the shaft portion 72J. Thus, the stopper member 112 is rotatable about its axis extending in the Z direction around the shaft portion 72J. In other words, the stopper member 112 is coupled to the first link member 104 to be rotatable relative to the first link member 104 in the X-Y plane. When the member 112 is coupled to the first link member 104, the arm 114 has its X side end portion (distal end portion) aligned with the X side end portion of the long hole 72H in the Y direction. The dimension of the arm 114 in the X direction is longer than the long hole 72H. When viewed in the Z direction, the arm 114 has its part overlapping part of the long hole 72H in the X direction when the stopper member 112 is rotated relative to the first link member 104.

The recess 116 is, for example, disposed at a −Y side portion of an X-direction center portion of the arm 114. The −Y side portion refers to the portion near the support pin 47 (see FIG. 10). A portion of the recess 116 extends to the −Z side from the −Y side end portion of the arm 114 into a flange to open to the −Y side. When viewed in the Z direction, the recess 116 has a trapezoidal shape having a X-direction center portion set back to the Y side. The recess 116 has a size with which the inner wall surface of the recess 116 and the outer peripheral surface of the support pin 47 (see FIG. 10) come into contact with each other in the X direction and the Y direction.

The recess 116 is disposed to come into contact with the Y side of the support pin 47 (see FIG. 10). When the stopper member 112 is rotated in a direction in which the recess 116 moves to the −Y side while the support pin 47 is not located on the −Y side of the recess 116, part of the recess 116 comes into contact with part of the overhanging portion 72F. Specifically, the overhanging portion 72F restricts an excessive rotation of the stopper member 112 to the −Y side.

The protrusion 118 is, for example, disposed at a portion on the X side and the Y side (on the opposite side from the support pin 47) of an X-direction center portion of the arm 114. Specifically, the protrusion 118 is disposed at a portion of the arm 114 on the X side of the recess 116. The protrusion 118 includes an upright surface 118A, which faces the X side and stands erect from the arm 114 in the Y direction, and an upper surface 118B, which extends to the −X side from the Y side end portion of the upright surface 118A.

Figure 13:
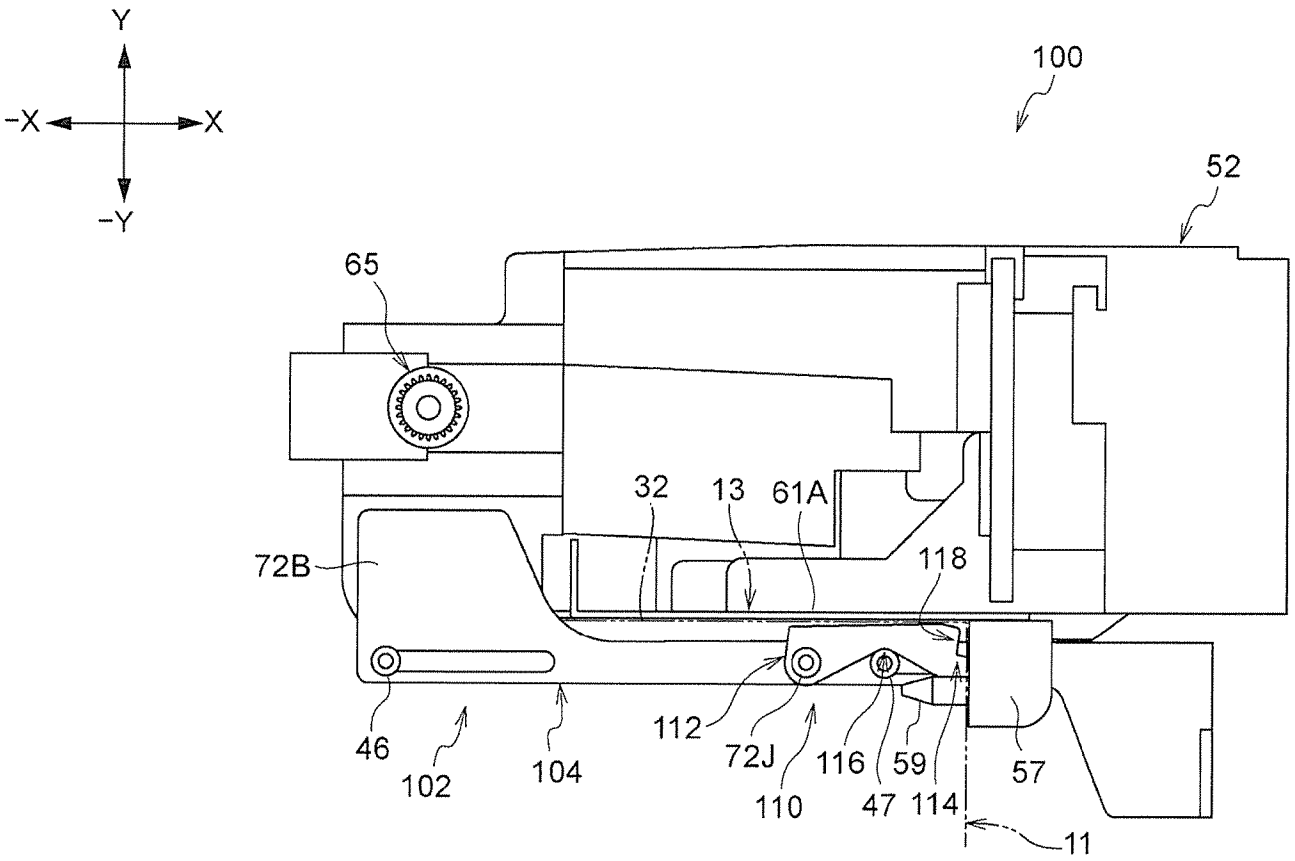
FIG. 13 illustrates the stopper member according to the second exemplary embodiment that has stopped restricting the attachment.

As illustrated in FIG. 13, when viewed in the Z direction, the upper surface on the Y side of the link member 102 is located to the −Y side of the upper surface on the Y side of the bottom wall 32 of the receiving member 13 when the link member 102 is in the second position and the support pin 47 is in the bottom of the recess 116. In the state where the fixing unit 52 illustrated in FIG. 9 is attached to the receiving member 13, the stopper member 112 rotates to the Y side about the shaft portion 72J with an operation of switching the link member 102 to the first position. Here, the protrusion 118 of the stopper member 112 rises to the Y side and enters the recess 61D (see FIG. 5) of the fixing unit 52. Specifically, in the state where the fixing unit 52 is attached to the receiving member 13, the fixing unit 52 does not restrict the rotation of the stopper member 112 even after the link member 102 is switched (moved) to the first position and the second position.

Figure 12:
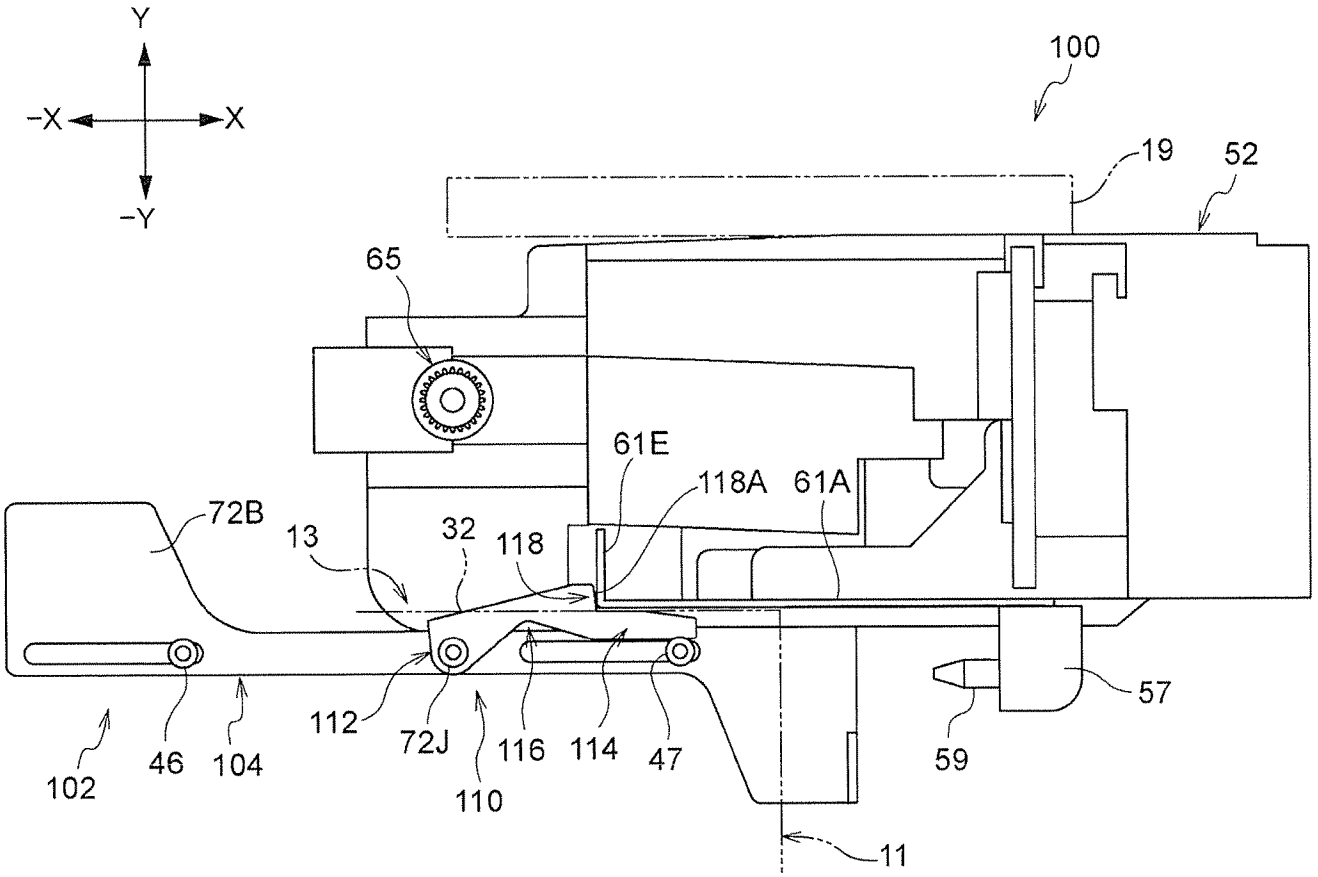
FIG. 12 illustrates a stopper member according to a second exemplary embodiment restricting an attachment of the fixing unit to the receiving member.

As illustrated in FIG. 12, the restricting portion 110 restricts an attachment of the fixing unit 52 to the receiving member 13 in the state where the fixing unit 52 is removed from the receiving member 13 and the link member 102 is placed in the first position. Specifically, in the state where the fixing unit 52 is removed from the receiving member 13 and the link member 102 is switched to the first position, the support pin 47 comes into contact with a portion of the arm 114 not aligned with the recess 116 (−Y side end surface at the X side end portion of the arm 114). Thus, the X side end portion of the arm 114 is pushed up to the Y side. Here, the protrusion 118 rises to the Y side beyond the surface on the −Y side of the bottom portion 61A of the fixing unit 52. The movement of the protrusion 118 from the X side to the −X side of the fixing unit 52 is restricted as a result of the contact between the upright surface 118A and the fixing unit 52 moving from the X side to the −X side.

As illustrated in FIG. 13, in the state where the fixing unit 52 is attached to the receiving member 13 and the link member 102 is switched to the second position, the restricting portion 110 allows the support pin 47 to come into contact with the recess 116 and the fixing unit 52 to move in the X direction. Specifically, in the state where the fixing unit 52 is attached to the receiving member 13 and the link member 102 is switched to the second position, the X side end portion of the arm 114 is moved to the −Y side as a result of the support pin 47 coming into contact with the recess 116 (entering the recess 116). At this time, the protrusion 118 is moved to the −Y side of the bottom portion 61A of the fixing unit 52. Thus, the fixing unit 52 that has had its X-direction movement restricted is released.

As described above, the restricting portion 110 restricts an attachment of the fixing unit 52 to the receiving member 13 with the operation of moving the link member 102 to the first position, and releases the attachment with the operation of moving the link member 102 to the second position.

Operation

An operation of the second exemplary embodiment is described now.

Attachment of Fixing Unit

As illustrated in FIG. 10, a case is assumed where an operator mistakenly switches the link member 102 from the second position to the first position while the fixing unit 52 is removed.

Here, as illustrated in FIG. 12, in the state where the link member 102 is mistakenly switched to the first position by an operator, the protrusion 118 rises to the Y side as a result of the support pin 47 and the stopper member 112 coming into contact with each other. Thus, when the fixing unit 52 is moved from the X side to the −X side toward the receiving member 13 along the guide member 19, part (wall portion 61E) of the fixing unit 52 comes into contact with the protrusion 118, so that the fixing unit 52 is prevented from being attached to the receiving member 13. The guide member 19 prevents the fixing unit 52 from crossing over the protrusion 118 on the Y side. While the fixing unit 52 is prevented from being attached to the receiving member 13, the operator identifies the link member 102 in the first position. The link member 102 is then switched to the second position by the operator.

As illustrated in FIG. 13, when the link member 102 is in the second position and the protrusion 118 of the stopper member 112 is disposed on the −Y side of the bottom portion 61A, the fixing unit 52 is allowed to be attached to the receiving member 13. Thus, the fixing unit 52 is attached to the receiving member 13. FIG. 12 and FIG. 13 do not include an illustration of the stud 34A (see FIG. 10).

As illustrated in FIG. 9, when the link member 102 is switched to the first position while the fixing unit 52 is attached to the receiving member 13, the coupling member 54 (see FIG. 10) projects to the Z side to be connected to the coupling member 65. At this time, the stopper member 112 is rotated and the protrusion 118 rises to the Y side, but the protrusion 118 enters the recess 61D (see FIG. 5) of the fixing unit 52. Thus, the stopper member 112 and the fixing unit 52 do not come into contact with each other. In this state, when the fixing unit 52 is moved (by mistake) to the X side, the Y side end portion of the link member 102 and part of the bottom portion 61A of the fixing unit 52 come into contact with each other, so that the X-side movement (removal) of the fixing unit 52 is restricted.

Removal of Fixing Unit

In the state, illustrated in FIG. 9, where the fixing unit 52 is attached, the link member 102 is switched to the second position (X side). At this time, the link member 102 is switched (moved) to the X side while the surface on the −Y side of the arm 114 is in contact with the support pin 47. The support pin 47 is relatively moved into the recess 116 from the surface on the −Y side of the arm 114.

As illustrated in FIG. 13, when the support pin 47 is relatively moved into the recess 116, the stopper member 112 is rotated, the support pin 47 comes into contact with the recess 116, and the protrusion 118 is moved to the −Y side. In this state, the fixing unit 52 is moved to the X side to be removed from the receiving member 13.

When the link member 102 is in the second position while the fixing unit 52 is removed from the receiving member 13, the fixing unit 52 is allowed to be attached to the receiving member 13. On the other hand, when the link member 102 is mistakenly placed in the first position, as described above, the stopper member 112 restricts an attachment of the fixing unit 52 to the receiving member 13.

As described above, in the removable structure 100, when the link member 102 is in the first position, the stopper member 112 restricts an attachment of the fixing unit 52 to the receiving member 13. Specifically, the fixing unit 52 is prevented from being attached to the receiving member 13 while the coupling member 54 is projecting to the X side toward the apparatus body 11.

In the removable structure 100, the fixing unit 52 is prevented from being attached to the receiving member 13 with an operation of placing the link member 102 in the first position. Specifically, switching of the link member 102 to the first position and restriction on an attachment of the fixing unit 52 are performed concurrently. This structure further simplifies restriction on the attachment of the fixing unit 52 than the structure where switching of the link member 102 is performed independently of restriction on the attachment of the fixing unit 52 to the receiving member 13.

In the removable structure 100, the attachment is released with an operation of placing the link member 102 in the second position. Specifically, switching of the link member 102 to the second position and release of the attachment of the fixing unit 52 are performed concurrently. This structure further simplifies the release of the attachment of the fixing unit 52 than the structure where switching of the link member 102 is performed independently of the release of the attachment of the fixing unit 52 to the receiving member 13.

In addition, in the removable structure 100, the stopper member 112 of the restricting portion 110 is coupled to (included in) the link member 102. Thus, the area over which the link member 102 moves is closer to the area over which the stopper member 112 moves than in the structure where the stopper member 112 is apart from the link member 102. This structure facilitates interlinking of the stopper member 112 and the link member 102 with each other.

In the removable structure 100, the support pin 47 also serves as a guide member that guides the link member 102 in the X direction. This structure reduces the number of components compared to the structure including the support pin 47 and a guide member as separate members.

In the removable structure 100, the link member 102 has its position switched in the X direction. The first position is located closer to the rear side (−X side) of the apparatus body 11 than the second position. Thus, the link member 102 is pushed to the −X side to connect the coupling member 54 to the coupling member 65. This structure needs a smaller space between the fixing unit 52 and a covering 12 (see FIG. 1) in a closed state than the structure in which the first position is disposed closer to the front side than the second position. The apparatus body 11 thus has a smaller size.

In the image forming apparatus 10, the rotational force caused in the driver 26 is transmitted to the fixing roller 62 (see FIG. 3) via the coupling members 54 and 65 (see FIG. 3). In the removable structure 100, the coupling members 54 and 65 are prevented from being degraded. This structure thus further reduces variation of the rotational force transmitted to the fixing roller 62 than the structure not including the removable structure 100. This structure thus prevents the fixed toner from being displaced from a predetermined fixed position on the sheet P and reduces defects of the toner image G.

The present invention is not limited to the above-described exemplary embodiments.

Modification Example

Figure 14:
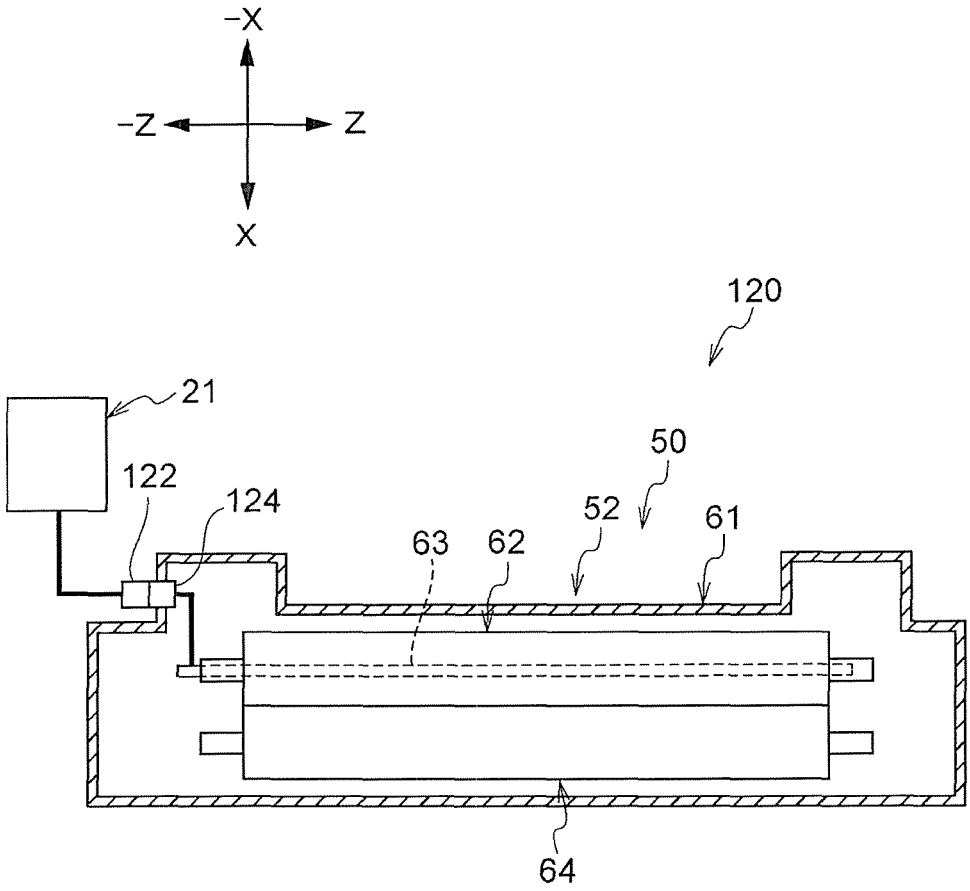
FIG. 14 illustrates an internal structure of a fixing unit according to a modification example.

FIG. 14 illustrates part of an image forming apparatus 120 according to a modification example. The image forming apparatus 120 includes a connector 122, which is an example of a connection member, and a connector 124, which is an example of a connectable member, instead of the coupling members 54 and 65 (see FIG. 3) in the removable structure 50 (see FIG. 1) of the image forming apparatus 10. Components and portions other than the connectors 122 and 124 are the same as those of the image forming apparatus 10 and the removable structure 50. The driver 26 (see FIG. 1) rotates the fixing roller 62 using gears, not illustrated.

The connectors 122 and 124 each include multiple terminals, not illustrated, and are capable of being energized while being connected together. The connector 122 is movable toward and away from the apparatus body 11 (see FIG. 1) in the Z direction. The connector 124 is disposed on the fixing unit 52. A power supply 21 energizes the connectors 122 and 124. A halogen heater 63 is an example of a heat generator. The halogen heater 63 generates heat when energized by the power supply 21 through the connectors 122 and 124 to fix a toner image G (see FIG. 1) to a sheet P.

The image forming apparatus 120 prevents connection portions (terminals) of the connectors 122 and 124 from being degraded with the effects the same as those of the removable structure 50 according to the first exemplary embodiment. This structure further reduces variation of power fed to the halogen heater 63 than the structure not including the removable structure 50. This structure thus prevents a reduction of the amount of heat fed to the toner fixed to the sheet P compared to the predetermined amount of heat, and thus reduces defects (such as a cold-offset) of the toner image G.

Other Modification Example

The removable structure 50 may either hold the link member 56 with an operation of removing the fixing unit 52 or release the held link member 56 with an operation of attaching the fixing unit 52. For example, the structure may manually release the link member 56 automatically held in the second position with an operation of removing the fixing unit 52. Alternatively, the structure may include a member that manually holds the link member 56 in the second position after the removal of the fixing unit 52, and may automatically release the link member 56 held by the member with an operation of attaching the fixing unit 52.

In the removable structure 50, instead of the support pin 47, the lock member 82 may include a portion protruding toward the apparatus body 11, the apparatus body 11 may have a recess that comes into contact with the protruding portion, and the lock member 82 may be held by bringing the protruding portion and the recess into contact with each other. Specifically, the body member is not limited to a protrusion protruding from the apparatus body 11 and may be a recessed member disposed on the apparatus body 11 or a recess formed in the apparatus body 11. Instead of the coil spring 84, the removable structure 50 may utilize the weight of the lock member 82. Instead of the coil spring 84, the removable structure 50 may include an extension spring to pull the hook portion 87 to the −Y side.

In the removable structure 50, the support pin 47 may have only a function of receiving the hook portion 87 without a function of a guide member that guides the link member 56 in the X direction. In the removable structure 50, the first position may be disposed closer to the front side (X side) of the apparatus body 11 than the second position. Modification examples of the removable structure 50 may include a connector 122 and a connector 124 instead of the coupling members 54 and 65.

In the removable structure 100, the link member 102 may either restrict an attachment of the fixing unit 52 with an operation of placing the link member 102 in the first position, or release the attachment with an operation of placing the link member 102 in the second position. For example, in the structure that restricts an attachment of the fixing unit 52 with an operation of placing the link member 102 in the first position, the release may be manually performed while the link member 102 is in the second position. Alternatively, the link member 102, while in the second position, may protrude with an operation of removing the fixing unit 52 to restrict the attachment of the fixing unit 52.

The removable structure 100 may exclude the support pin 47 and the recess 116. For example, the stopper member 112 may include a protrusion that protrudes toward the apparatus body 11, and the protrusion may be guided by a guide portion (for example, a guide groove) formed on the apparatus body 11 to rotate the stopper member 112.

In the removable structure 100, the support pin 47 may have only a function of coming into contact with the stopper member 112 without a function of a guide member that guides the link member 102 in the X direction. In the removable structure 100, the first position may be disposed closer to the front side (X side) of the apparatus body 11 than the second position. The removable structure 100 according to an exemplary embodiment or the removable structure 100 according to a modification example may include a connector 122 and a connector 124 instead of the coupling members 54 and 65.

An operator may be notified of whether the link member 56 is being held or released or whether an attachment of the fixing unit 52 is restricted or released through a display such as a display panel or with a sound.

The assembly is not limited to the fixing unit 52 and may be, for example, the image forming unit 25, the transfer unit 27, or a unit for correcting bends of the sheets P.

The fixing unit 52 may be attached and removed in the Z direction or the Y direction instead of the X direction. The direction in which a switching member switches the connection member may be determined to be a direction the same as the direction in which the fixing unit 52 is attached or removed.

A rotator may be, instead of the fixing roller 62, a fixing belt or a transfer roller of a transfer unit.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An assembly removable structure, comprising:

an assembly that includes a connectable member and that is attached to and removed from a receiving member of an apparatus body in a first direction;

a connection member disposed on the apparatus body to be movable forward and backward in a cross direction that crosses the first direction, the connection member being connected to the connectable member while being in a projecting state;

a switch member that is operated independently of a lid member and that is capable of switching the connection member between a first position, in which the connection member is connected to the connectable member, and a second position, in which the connection member is removed from the connectable member, the lid member rendering the receiving member open and closed; and a holding device that holds the switch member in the second position when the assembly is removed from the receiving member.

2. The assembly removable structure according to claim 1, wherein the holding device holds the switch member in the second position with an operation of removing the assembly from the receiving member.

3. The assembly removable structure according to claim 2, wherein the holding device includes a body member disposed on the apparatus body, and a hook member connected to the switch member to be rotatable about an axis extending in the cross direction, the hook member including a hook portion, hooked on the body member, and a release portion, which releases the hooked hook portion by rotating with a contact with the assembly.

4. The assembly removable structure according to claim 3, wherein the holding device includes a pressing member that presses the hook member for the hook portion to rotate in a direction in which the hook portion is hooked on the body member.

5. The assembly removable structure according to claim 3, wherein the body member also serves as a guide member that guides the switch member in the first direction.

6. The assembly removable structure according to claim 1, wherein the holding device releases the held switch member with an operation of attaching the assembly to the receiving member.

7. The assembly removable structure according to claim 1, wherein the switch member is switched in position in the first direction, and wherein the first position is closer to a rear side of the apparatus body than the second position.

8. An image forming apparatus that forms an image on a recording medium, the image forming apparatus comprising the assembly removable structure according to claim 1, wherein each of the connection member and the connectable member is rotatable about an axis extending in the cross direction, wherein the apparatus body includes a driver that drives the connection member to rotate, and wherein the assembly includes a rotator that rotates with a rotational force transmitted from the driver via the connection member and the connectable member.

9. An assembly removable structure, comprising:

an assembly that includes a connectable member and that is attached to and removed from a receiving member of an apparatus body in a first direction;

a connection member disposed on the apparatus body to be movable forward and backward in a cross direction that crosses the first direction, the connection member being connected to the connectable member while being in a projecting state;

a switch member that is operated independently of a lid member and that is capable of switching the connection member between a first position, in which the connection member is connected to the connectable member, and a second position, in which the connection member is removed from the connectable member, the lid member rendering the receiving member open and closed; and a restricting device that restricts an attachment of the assembly to the receiving member when the assembly is removed from the receiving member and the switch member is in the first position.

10. The assembly removable structure according to claim 9, wherein the restricting device restricts an attachment of the assembly to the receiving member with an operation of placing the switch member in the first position.

11. The assembly removable structure according to claim 10, wherein the restricting device includes a body member disposed on the apparatus body, and a coupling member coupled to the switch member to be rotatable about an axis extending in the cross direction, the coupling member including an arm extending in the first direction, a recess formed in the arm at a portion closer to the body member, and a protrusion disposed on the arm at a portion opposite to the portion closer to the body member, wherein, when the switch member is switched to the first position, the body member comes into contact with a portion of the arm other than the recess and the protrusion restricts the assembly from moving in the first direction, and wherein, when the switch member is switched to the second position, the body member comes into contact with the recess to allow the assembly to move in the first direction.

12. The assembly removable structure according to claim 9, wherein the restricting device releases the attachment with an operation of placing the switch member in the second position.

* * * * *